US005895153A

United States Patent [19]

Aslam et al.

[11] Patent Number: 5,895,153

[45] Date of Patent: Apr. 20, 1999

[54] MECHANISM FOR TRACKING THE BELT OF A BELT FUSER

[75] Inventors: Muhammed Aslam, Rochester; Robert D. Bobo, Ontario; Socrates Hryhorenko, Sodus, all of N.Y.

[73] Assignee: Eastman Kodak Company, Rochester, N.Y.

[21] Appl. No.: 08/992,056

[22] Filed: Dec. 17, 1997

[51] Int. Cl.[6] ..... G03G 15/20; G03G 15/00

[52] U.S. Cl. ..... 399/329; 226/18; 399/165

[58] Field of Search ..... 399/329, 67, 68, 399/122, 320, 321, 75, 162, 163, 165, 384; 347/154, 156; 226/18, 21, 23, 45; 198/806, 807; 430/124

[56] References Cited

U.S. PATENT DOCUMENTS

| | | | |
|---|---|---|---|
| 4,265,198 | 5/1981 | Shinohara et al. | 399/67 X |
| 4,565,439 | 1/1986 | Reynolds | 399/329 |
| 4,572,417 | 2/1986 | Joseph et al. | 226/20 |
| 4,893,740 | 1/1990 | Hediger et al. | 226/23 |
| 5,225,877 | 7/1993 | Wong | 399/75 |
| 5,256,507 | 10/1993 | Aslam et al. | 430/42 |
| 5,365,321 | 11/1994 | Koshimizu et al. | 399/329 |
| 5,479,241 | 12/1995 | Hou et al. | 399/75 |
| 5,659,851 | 8/1997 | Moe et al. | 399/165 |
| 5,717,984 | 2/1998 | Wong | 399/165 |

*Primary Examiner*—Arthur T. Grimley
*Assistant Examiner*—Sophia S. Chen
*Attorney, Agent, or Firm*—Lawrence P. Kessler

[57] ABSTRACT

A reproduction apparatus where a colorant image is formed on a receiver member, and the colorant image is fixed on the receiver member by a belt fusing apparatus for providing image gloss to such colorant image. The belt fusing apparatus includes a heated fuser roller, a pressure roller in nip relation with the fuser roller, a steering roller, and a fusing belt entrained about the fuser roller and the steering roller for movement in a predetermined direction about a closed loop path. A mechanism is provided for accurately controlling the tracking of the fusing belt. The fusing belt tracking control mechanism includes supports the steering roller for rotation about its longitudinal axis, and for casterred and gimbaled movement. Sensors detect the respective lateral edges of the fusing belt, the sensors producing control signals when the respective lateral edges are detected for effecting casterred movement of the steering roller. Accordingly, the fusing belt is continuously progressively moved in a cross-track direction between lateral limits.

8 Claims, 3 Drawing Sheets

MECHANISM FOR TRACKING THE BELT OF A BELT FUSER

CROSS REFERENCE TO RELATED APPLICATIONS

U.S. patent application Ser. No. 08/992,872, filed Dec. 17, 1997, entitled "REPRODUCTION APPARATUS PROVIDING SELECTABLE IMAGE QUALITY AND GLOSS" in the name of Muhammed Aslam et al.

U.S. patent application Ser. No. 08/992,057, filed Dec. 17, 1997, entitled "BELT FUSING ACCESSORY WITH SELECTABLE FUSED IMAGE GLOSS" in the name of Muhammed Aslam et al.

U.S. patent application Ser. No. 08/992,643, filed Dec. 17, 1997, entitled "BELT FUSER APPARATUS FOR PREVENTING LINE ART TYPE MARKING PARTICLE OFFSET" in the name of Muhammed Aslam et al.

U.S. patent application Ser. No. 08/992,058, filed Dec. 17, 1997, entitled "APPLICATION OF CLEAR TONER DEVELOPED NEGATIVE TO THE IMAGE IN AN ELECTROPHOTOGRAPHIC PROCESS TO ELIMINATE IMAGE RELIEF AND DIFFERENTIAL GLOSS ARTIFACTS" in the name of William J. Staudenmayer et al.

U.S. patent application Ser. No. 08/992,746, filed Dec. 17, 1997, entitled "APPLICATION OF CLEAR MARKING PARTICLES TO IMAGES WHERE THE MARKING PARTICLE COVERAGE IS UNIFORMLY DECREASED TOWARDS THE EDGES OF THE RECEIVER MEMBER" in the name of Muhammed Aslam et al.

U.S. patent application Ser. No. 08/992,060, filed Dec. 17, 1997, entitled "COOLING AND REUSING THE HEAT TO PREHEAT THE FUSING WEB IN A BELT FUSER" in the name of Muhammed Aslam et al.

U.S. patent application Ser. No. 08/992,059, filed Dec. 17, 1997, entitled "A COLLAPSIBLE CUSTOMER REPLACEABLE BELT FUSER ASSEMBLY DESIGNED FOR ACCESSIBILITY, SERVICEABILITY, AND FUSING BELT REPLACEMENT" in the name of Muhammed Aslam et al.

U.S. patent application Ser. No. 08/992,745, filed Dec. 17, 1997, entitled "APPARATUS FOR PACKAGING AND INSTALLATION OF A FUSING BELT" in the name of Muhammed Aslam et al.

FIELD OF THE INVENTION

This invention is directed in general to a fusing apparatus for a reproduction apparatus, and more particularly to a belt fusing apparatus and a mechanism for tracking the fusing belt.

BACKGROUND OF THE INVENTION

Typical commercial reproduction apparatus include electrostatographic process copier/duplicators or printers, inkjet printers, and thermal printers. With such reproduction apparatus, pigmented marking particles, ink, or dye material (hereinafter referred to commonly as marking particles) are utilized to develop an image, of information to be reproduced, on a dielectric support member for transfer to a receiver member, or directly onto a receiver member. The receiver member bearing the marking particle image is transported through a fuser device where the image is fixed (fused) to the receiver member, for example, by heat and pressure to form a permanent reproduction thereon. While the fuser device is typically integral with the reproduction apparatus, it may also be an independent piece of equipment, generally referred to as an off line fuser. Off line fusers, being a device devoted to a single task, have the ability to be optimized to perform the fusing function.

Certain reproduction apparatus have been designed to produce multi-color copies. In such reproduction apparatus, multiple color separation images are respectfully developed with complimentary colored marking particles, in superposition on a receiver member. It has been found that fixing of multi-color marking particle images to a receiver member requires substantially different operating parameters than fixing standard black marking particle images to a receiver member. Moreover, the respective operating parameters may in fact be in contradistinction. That is, multi-color images require a high degree of glossiness for a full, rich depth of color reproduction; on the other hand, since glossiness for black marking particle images may significantly impair legibility, a matte finish is preferred.

It is known that the glossiness of a marking particle image is, at least in part, dependent upon the marking particle melting characteristics in the fixing process. In general, the fixing apparatus serves to soften or at least partially melt the marking particles, enabling the marking particles to permeate into the fibers of the receiver member so that the marking particles are fixed to the receiver member to give a glossy image reproduction. For example, the fixing apparatus may include a heated roller which contacts the marking particles and the receiver member. With multi-color marking particle images, the multiple color marking particle images are respectively melted and fixed by the heated roller. If the color marking particle images are not sufficiently melted, light scattering cavities may occur in the copy which degrades the color reproduction. Moreover, if the marking particles on the receiver member do not have a mirror-like surface, incident light is reflected by diffusion from the marking particle surface and is not admitted into the marking particle layers, making the colors on the receiver member appear dark and cloudy. Therefore, low melting point marking particles are used. They yield few cavities and a hard flat surface so as to give glossy and vivid colors in the reproduction.

Low melting point marking particles are subject to increased image offset to the heating roller. This can produce undesirable defects in the reproduction or subsequent reproductions. Although image offset can be reduced by application of fuser oil to the heating roller, the use of such oil introduces further complications into the fusing system, such as handling of the oil and making sure that the layer of oil on the roller is uniform for uniform heat application. Alternatively, a mechanical arrangement for reducing image offset, without the need for fuser oil, has been found. Such mechanical arrangement, as shown for example in U.S. Pat. No. 5,256,507 (issued Oct. 26, 1993, in the name of Aslam et al), provides an elongated web which is heated to melt the marking particles and then cooled to cool the particles and facilitate ready separation of the receiver member with the marking particle image fixed thereto from the elongated web. The nature of operation of the elongated web arrangement also serves to increase the glossiness of the fixed marking particle image. As a result, such arrangement is particularly useful for multi-color image fusing. It is, of course, important to provide for accurate control of the tracking of the elongated web for the belt fusing apparatus.

SUMMARY OF THE INVENTION

In view of the above, this invention is directed to a reproduction apparatus where a colorant image is formed on a receiver member, and the colorant image is fixed on the receiver member by a belt fusing apparatus for providing image gloss to such colorant image. The belt fusing apparatus includes a heated fuser roller, a pressure roller in nip relation with the fuser roller, a steering roller, and a fusing belt entrained about the fuser roller and the steering roller for movement in a predetermined direction about a closed loop path. A mechanism is provided for accurately controlling the tracking of the fusing belt. The fusing belt tracking control mechanism includes supports the steering roller for rotation about its longitudinal axis, and for casterred and gimbaled movement. Sensors detect the respective lateral edges of the fusing belt, the sensors producing control signals when the respective lateral edges are detected for effecting casterred movement of the steering roller. Accordingly, the fusing belt is continuously progressively moved in a cross-track direction between lateral limits.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
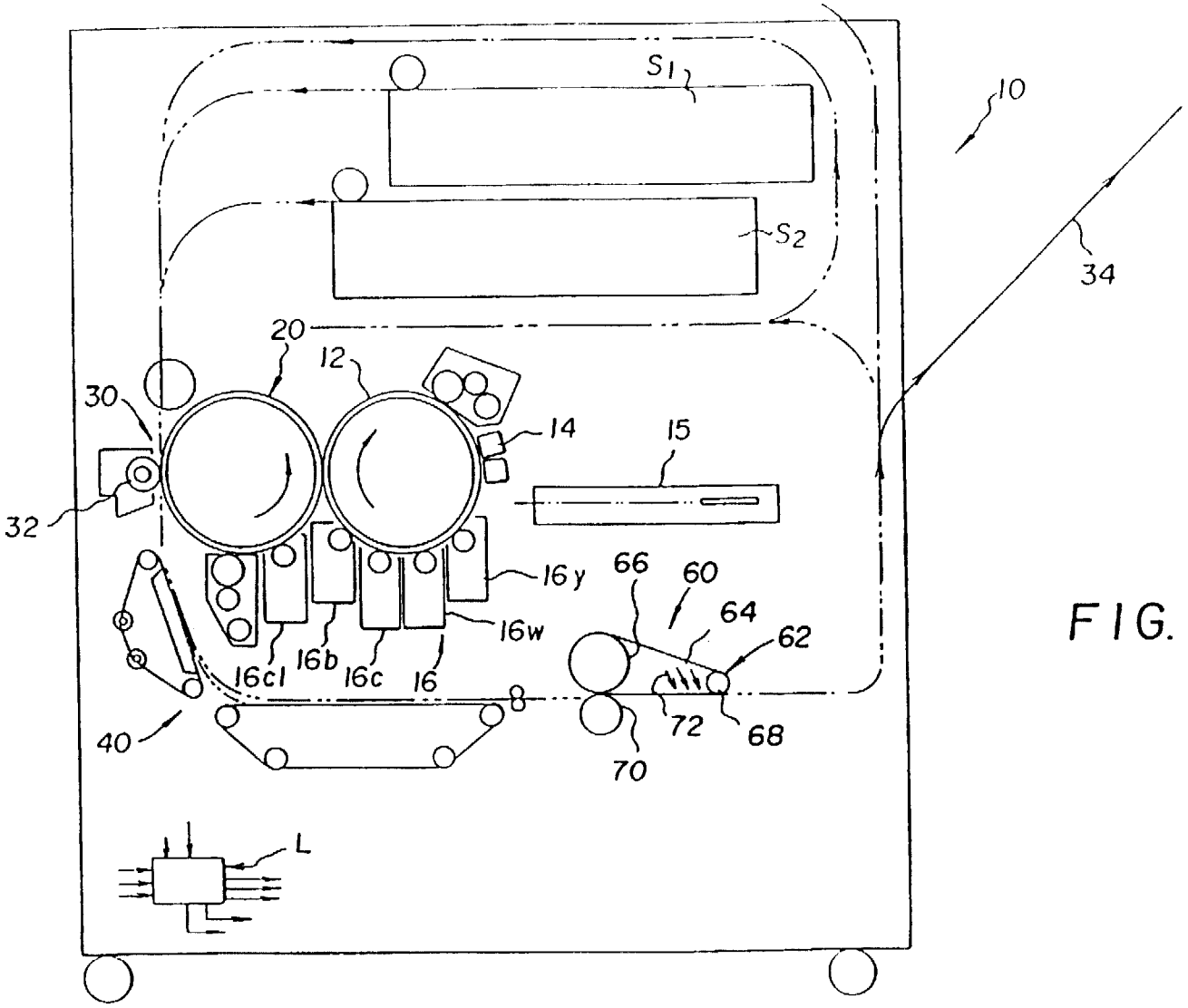
FIG. 1 is a front elevational view of an electrostatographic reproduction apparatus including a belt fusing apparatus utilizing the belt tracking control mechanism according to this invention.

Referring now to the accompanying drawings, an electrostatographic reproduction apparatus, designated generally by the numeral 10, is shown in FIG. 1. While the reproduction apparatus 10 is shown as an electrophotographic type reproduction apparatus, it is readily appreciated that the belt fusing accessory according to this invention is suitable for use with other types of reproduction apparatus, such as ink jet printers and thermal printers.

The reproduction apparatus 10 includes a primary image forming dielectric member, for example, a drum 12 having a photoconductive surface, upon which a pigmented marking particle image, or series of different color marking particle images, is formed. In order to form images, when the photoconductive drum 12 is rotated in the direction of the arrow associated therewith, the photoconductive surface of drum is uniformly charged, and then exposed imagewise by, for example, a laser 15 or light emitting diode (LED) array, to create a corresponding latent electrostatic image. The latent electrostatic image is developed by a application of pigmented marking particles to the image bearing drum 12 by a development station 16. In the embodiment of the reproduction apparatus 10 as shown, there are five developing units, each unit having particular different color marking particles associated respectively therewith. Specifically, developing unit 16*y* contains yellow marking particles, developing unit 16*m* contains magenta marking particles, developing unit 16*c* contains cyan marking particles, and developing unit 16*b* contains black marking particles. Of course, other color marking particles (e.g. red, green, blue, etc.) may be used in the particular developing units depending upon the overall arrangement of the development station 16 and operational characteristics of the color development scheme for the reproduction apparatus 10. Additionally, a developing unit 16*c*1 is provided, containing clear marking particles, which is utilized to aid in improving the quality and gloss of reproduced images, in the manner more fully described in the copending U.S. patent application Ser. No. 08/992,872, filed on even date herewith.

Each developer unit is separately activated for operative developing relation with drum 12 to apply different color marking particles respectively to a series of images carried on drum 12 to create a series of different color marking particle images. The developed marking particle image is transferred (or multiple marking particle images are transferred one after another in registration) to the outer surface of a secondary or intermediate image transfer member, for example, an intermediate transfer drum 20. Thereafter, the single marking particle image, or a multicolor image comprising multiple marking particle images respectively formed on the surface of the intermediate image transfer member drum 20, is transferred in a single step to a receiver member.

The receiver member is transported along a path (designated by chain-link lines) into a nip 30 between intermediate image transfer member drum 20 and a transfer backing member, for example a roller 32. The receiver member is delivered from a suitable receiver member supply (hopper $S_1$ or $S_2$) into nip 30 where it receives the marking particle image. The receiving member exits the nip 30, and is transported by transport mechanism 40 to a fuser assembly 60 where the marking particle image is tacked to the receiver member by application of heat and/or pressure. After tacking the image to the receiver member, the receiver member is selectively transported to return to the transfer nip 30 to have a second side (duplex) image transferred to such receiver member, to a remote output tray 34 for operator retrieval, or to an output accessory such as the belt fusing accessory, according to this invention, designated generally by the numeral 70.

Appropriate sensors (not shown) of any well known type, such as mechanical, electrical, or optical for example, are utilized in the reproduction apparatus 10 to provide control signals for the apparatus. Such sensors are located along the receiver member travel path and are associated with the primary image forming member photoconductive drum 12, the intermediate image transfer member drum 20, the transfer backing member roller 32, and various image processing stations. As such, the sensors detect the location of a receiver member in its travel path, and the position of the primary image forming member photoconductive drum 12 in relation to the image forming processing stations, and respectively produce appropriate signals indicative thereof. Such signals are fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

The belt fusing apparatus 60, according to this invention, is shown as being integral with the reproduction apparatus 10. The belt fusing apparatus 60 includes an input transport for delivering marking particle image-bearing receiver members to a fusing assembly, designated generally by the numeral 62. The fusing assembly 62 comprises a fusing belt 64 entrained about a heated fusing roller 66 and a steering roller 68, for movement in a predetermined direction about a closed loop path. The fusing belt 64 is, for example, a thin metallic or heat resistant plastic belt. Metal belts can be electroformed nickel, stainless steel, aluminum, copper or other such metals, with the belt thickness being about 2 to 5 mils. Seamless plastic belts can be formed of materials such as polyimide, polypropylene, or the like, with the belt thickness summarily being about 2 to 5 mils. Usually these fusing belts are coated with thin hard coatings of release material such as silicone resins, fluoropolymers, or the like. The coatings are typically thin (1 to 10 microns), very smooth, and shiny. Such fusing belts could also be made with some textured surface to produce images of lower gloss or texture.

A pressure roller 70 is located in nip relation with the heated fusing roller 66. A flow of air is directed at the area 72 of the belt run upstream of the steering roller 68 and adjacent to the steering roller to cool such area. The cooling action provides for a commensurate cooling of a receiver member, bearing a marking particle image, while such member is in contact with the fusing belt 64. The cooling action for the receiver member serves as the mechanism to substantially prevent offset of the marking particle image to the pressure roller.

Figure 2:
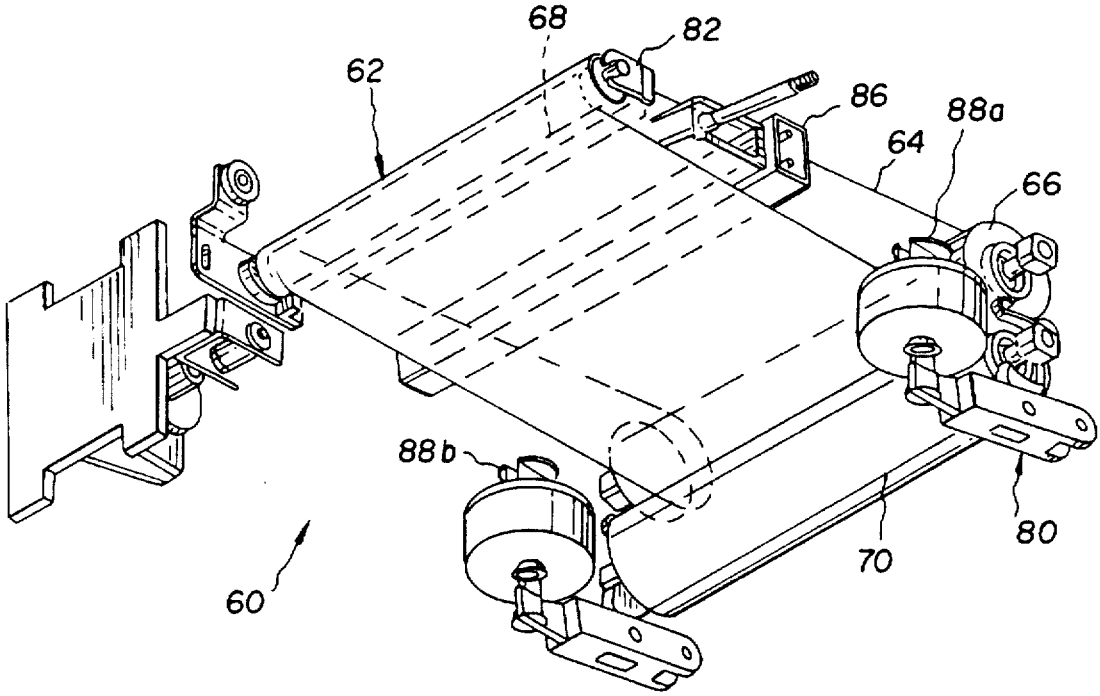
FIG. 2 is a view, in perspective and on an enlarged scale, of a portion of the belt fusing apparatus and the belt tracking control mechanism according to this invention.
Figure 3:
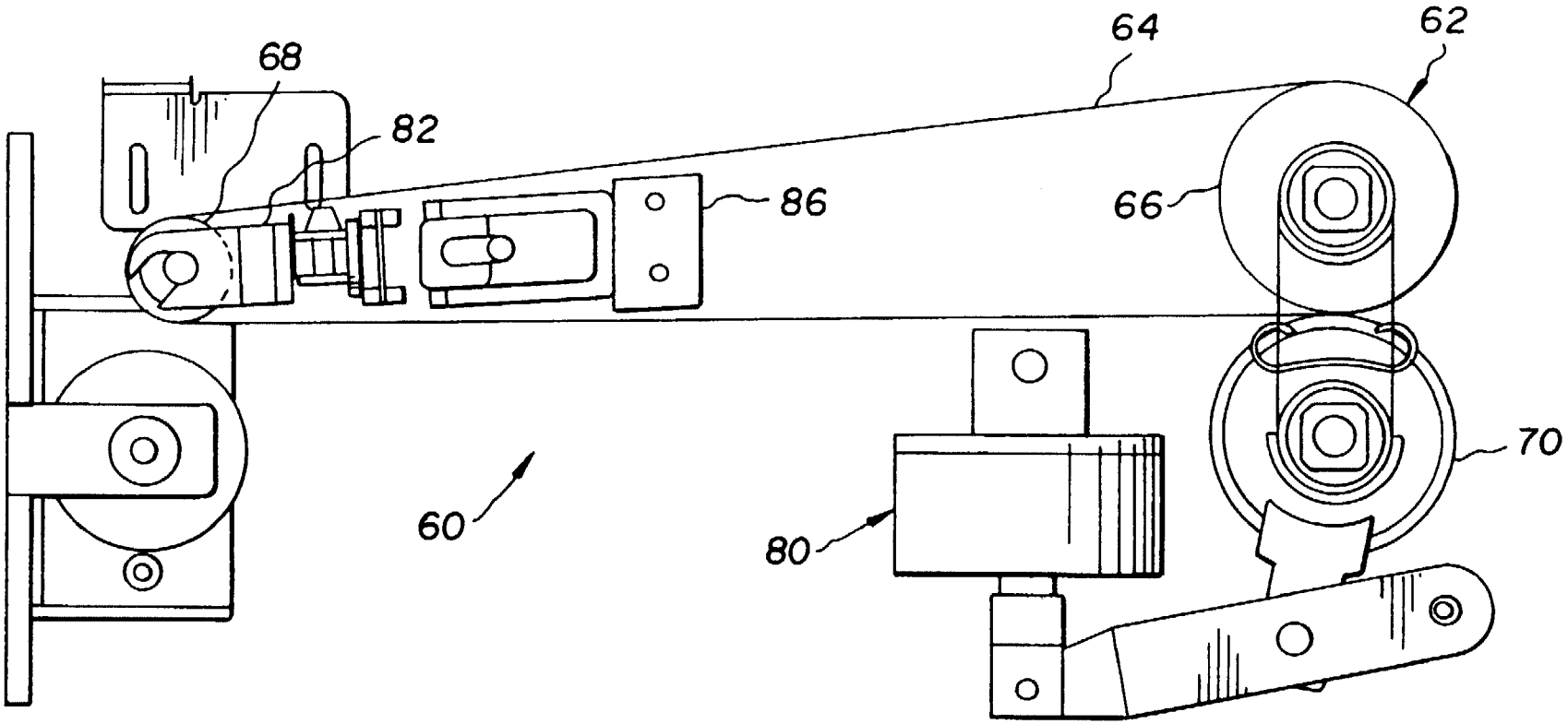
FIG. 3 is a front elevational view, on an enlarged scale, of a portion of the belt fusing apparatus and the belt tracking control mechanism according to this invention.

The belt fusing apparatus 60 is mounted in operative association with a belt tracking control mechanism according to this invention. The belt tracking control mechanism, designated generally by the numeral 80, is best shown in FIGS. 2 and 3. The steering roller 68 is supported in a yoke 82 for rotation about the longitudinal axis of the steering roller. The yoke 82 is urged, for example, by a compression spring 84 in a direction away from the fuser roller 66 in order to maintain a predetermined tension on the fuser belt 64. The yoke 82 is mounted in a cantilever fashion from a frame 86, in any suitable manner, to provide for castering and gambling movement of the steering roller 68 with the yoke. One such mounting arrangement is shown in U.S. Pat. No. 4,893,740, issued Jan. 16, 1990, in the names of Hediger et al.

The lateral edges of the fusing belt 64 are detected by respective sensors 88*a* and 88*b*. Signals produced by the sensors are fed to a logic and control unit, such as unit L of the reproduction apparatus 10, to control the positioning of the yoke 82, and thus the steering roller 68, about the caster axis. Accordingly, upon a predetermined lateral (cross-track) movement of the fusing belt 64, one of the sensors (e.g., 88*a*) detects the associated edge of the fusing belt. An appropriate signal is sent to the logic and control unit to provide for the rotation of the steering roller 68 about the caster axis a predetermined amount to cause the fusing belt 64 to gradually precess so that the opposite edge progressively moves toward its associated sensor (e.g., 88*b*). When the lateral edge of the fusing belt 64 reaches the other extreme (that is, is detected by the associated sensor), the steering roller 68 is caused to rotate in the opposite direction about the caster axis to gradually precess so that the opposite edge moves progressively toward its associated sensor. This cycle continues thus controlling the tracking of the fusing belt 64 to keep within specified lateral limits. See, for example, U.S. Pat. No. 4,572,417, issued Feb. 25, 1986, in the names of Joseph et al. The steering roller 64 is also moved about the gimbal axis so as to take in account any conicity in fusing belt 64. As such the tracking of the fuser belt is accurately controlled by the belt tracking control mechanism 80.

Figure 4:
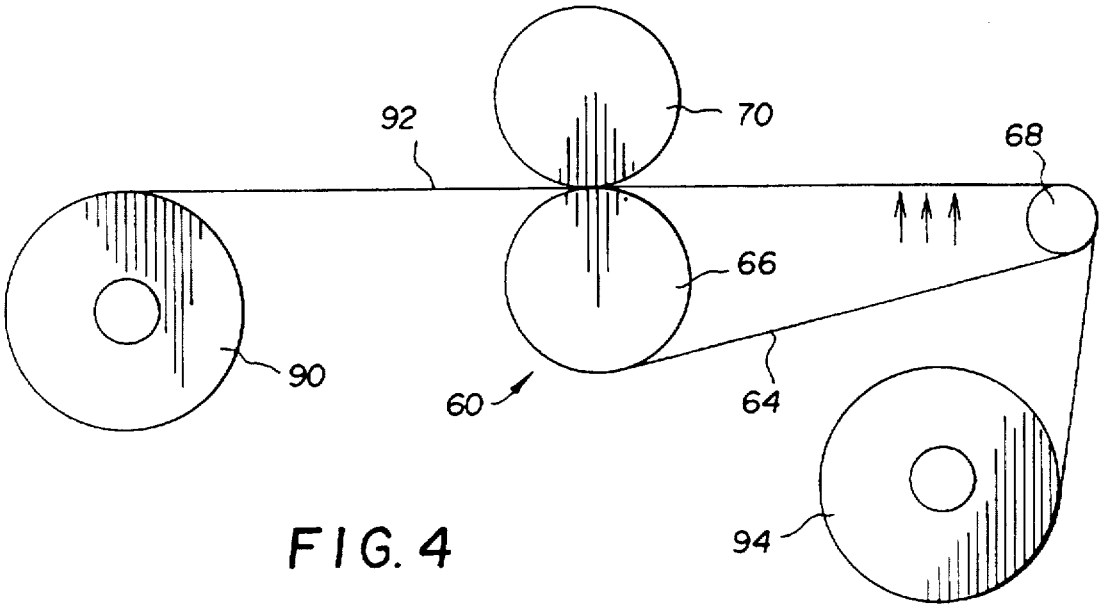
FIG. 4 is a schematic illustration of a belt fusing apparatus, such as that shown in FIGS. 1–3, utilized to fuse a roll fed continuous receiver member.

In certain reproduction apparatus, the receiver member to which a colorant image (including a clear protective overcoat) is to be fused, is in the form of a continuous web roll. A schematic illustration of such an arrangement is shown in FIG. 4. It should be noted that both the receiver web and the fuser belt be controlled for accurate tracking to prevent damage to the reproductions. As such, the receiver supply roll 90 should also be gimbaled and steered in a similar fashion to that of the fusing belt tracking control mechanism 80, as described above, to keep the receiver web 92 aligned and tracked with the fusing belt 64. The lateral edge position of the receiver web 92 can also be sensed with respect to the fusing belt 64, and accordingly a feedback signal sent to the receiver web steering device to correct the receiver web position. Another way of keeping the receiver web 92 in line with the fusing belt 64 would be to gimbal the web supply roll 90 to provide required tension and steer the receiver web with a guide which is aligned with the fusing belt.

The invention has been described in detail with particular reference to certain preferred embodiments thereof, but it will be understood that variations and modifications can be effected within the spirit and scope of the invention.

What is claimed is:

1. A belt fusing apparatus for providing image gloss to a colorant image formed on a receiver member by a reproduction apparatus, said belt fusing apparatus comprising:

a heated fuser roller;

a pressure roller in nip relation with said fuser roller;

a steering roller;

a fusing belt entrained about said fuser roller and said steering roller for movement in a predetermined direction about a closed loop path; and a mechanism for accurately controlling the tracking of said fusing belt, whereby said fusing belt is continuously progressively moved in a cross-track direction between lateral limits.

2. The belt fusing apparatus of claim 1 wherein said fusing belt tracking control mechanism includes means for supporting said steering roller for rotation about its longitudinal axis, and for casterred and gimbaled movement.

3. The belt fusing apparatus of claim 2 wherein said steering roller support means includes a yoke, said steering roller being mounted for free rotation in said yoke.

4. The belt fusing apparatus of claim 2 wherein said steering roller support means includes means for urging said steering roller in a direction to maintain a desired tension on said fusing belt.

5. The belt fusing apparatus of claim 1 wherein said fusing belt tracking control mechanism includes sensors for detecting the respective lateral edges of said fusing belt, said sensors producing control signals when said respective lateral edges are detected.

6. In a reproduction apparatus where a colorant image is formed on a receiver member, and said colorant image is fixed on said receiver member by a belt fusing apparatus for providing image gloss to such colorant image, said belt fusing apparatus including a heated fuser roller, a pressure roller in nip relation with said fuser roller, a steering roller, and a fusing belt entrained about said fuser roller and said steering roller for movement in a predetermined direction about a closed loop path, a mechanism for accurately controlling the tracking of said fusing belt, said fusing belt tracking control mechanism comprising:

means for supporting said steering roller for rotation about its longitudinal axis, and for casterred and gimbaled movement; and sensors for detecting the respective lateral edges of said fusing belt, said sensors producing control signals when said respective lateral edges are detected for effecting casterred movement of said steering roller, whereby said fusing belt is continuously progressively moved in a cross-track direction between lateral limits.

7. The belt fusing apparatus of claim 6 wherein said steering roller support means includes means for urging said steering roller in a direction to maintain a desired tension on said fusing belt.

8. In a reproduction apparatus where a colorant image is formed on an elongate continuous web receiver member, and said colorant image is fixed on said elongate continuous web receiver member by a belt fusing apparatus for providing image gloss to such colorant image, said belt fusing apparatus including a heated fuser roller, a pressure roller in nip relation with said fuser roller, a steering roller, and a fusing belt entrained about said fuser roller and said steering roller for movement in a predetermined direction about a closed loop path, a mechanism for accurately controlling the tracking of said fusing belt, said fusing belt tracking control mechanism comprising:

means for supporting said steering roller for rotation about its longitudinal axis, and for casterred and gimbaled movement;

means for urging said steering roller in a direction to maintain a desired tension on said fusing belt;

sensors for detecting the respective lateral edges of said fusing belt, said sensors producing control signals when said respective lateral edges are detected for effecting casterred movement of said steering roller, whereby said fusing belt is continuously progressively moved in a cross-track direction between lateral limits; and means for accurately tracking said elongate continuous web receiver member so as to be aligned and tracked with the fusing belt.

* * * * *